US005365696A

United States Patent [19]

Ruiz

[11] Patent Number: 5,365,696

[45] Date of Patent: Nov. 22, 1994

[54] SECURITY DOORS

[76] Inventor: Frank N. Ruiz, 2404 S. 18th St., Council Bluffs, Iowa 51501

[21] Appl. No.: 221,199

[22] Filed: Mar. 31, 1994

[51] Int. Cl.[5] ..... E05C 7/02

[52] U.S. Cl. ..... 49/67; 49/56; 49/506

[58] Field of Search ..... 49/67, 63, 56, 50, 61, 49/506

[56] References Cited

U.S. PATENT DOCUMENTS

| | | | |
|---|---|---|---|
| 3,693,293 | 9/1972 | Egan, Jr. et al. | 49/56 |
| 3,832,805 | 9/1974 | Stevens | 49/56 X |
| 4,484,410 | 11/1984 | English | 49/56 X |
| 4,575,965 | 3/1986 | Iversen | 49/61 X |
| 4,644,688 | 2/1987 | Benderoff | 49/67 |
| 4,937,975 | 7/1990 | Zilkha | 49/56 |
| 4,962,954 | 10/1990 | Ross | 49/56 X |

*Primary Examiner*—Philip C. Kannan
*Attorney, Agent, or Firm*—Zarley, McKee, Thomte, Voorhees & Sease

[57] ABSTRACT

A security door structure is affixed to an opening in a building wall exteriorly of a combination affixed glass door and sliding glass door to prevent in entrance by an intruder through the glass doors. The security door structure includes a first rigid metal frame with top and bottom rails and opposing vertical side rails and a plurality of rigid metal bars affixed between the rails. The metal bars are mounted at a predetermined distance from each other to prevent passage of a human body therebetween. The first metal frame is affixed exteriorly of the affixed glass door, and extends the same height and width as the affixed glass door. A second metal frame is pivotally mounted about a vertical axis to the first metal frame to swing between a closed position coplanar with the first metal frame and an open position pivoted exteriorly away from the coplanar position. The second metal frame includes top and bottom rails and opposing vertical side rails, and has a plurality of rigid metal bars affixed between the rails and spaced apart a distance from each other to prevent passage of a human body therebetween. A lock bracket is affixed to the interior face of the second metal frame and cooperates with a bracket mounted in the building wall opening interiorly of the security door structure, to permit selective locking of the pivotable door in the closed position, from the interior side of the security door structure.

2 Claims, 3 Drawing Sheets

SECURITY DOORS

TECHNICAL FIELD

The present invention relates generally to security doors formed of metal bars, and more particularly to a security door structure for securing sliding glass doors on a building.

BACKGROUND OF THE INVENTION

It has become a common practice to install metal bars in windows and doors, in order to prevent the access of intruders through the glass. In other situations, a separate hinged door structure of metal rods is pivotally connected in place of a storm door in an entry opening of a building.

However, a popular style of door structure for rooms opening onto decks and the like are sliding glass patio doors. While there are various apparatus for securing a sliding glass door, such apparatus generally relate to the securing of the door to prevent movement of the door. Thus, rods may be placed within the slide track of the door to prevent slidable movement of the door, and various locks may be utilized between the sliding door and door jamb to prevent sliding movement of the door. However, such devices do nothing to prevent an intruder from merely breaking the glass of the door and entering the building.

SUMMARY OF THE INVENTION

It is therefore a general object of the present invention to provide a security door structure for a sliding glass door entry to a building.

Yet another object is to provide a security door structure for sliding glass doors which is securable from the interior of the house.

Yet another object is to provide a security door structure which is simple to install and aesthetic in appearance.

These and other objects will be apparent to those skilled in the art.

The security door structure of the present invention is affixed to an opening in a building wall exteriorly of a combination affixed glass door and sliding glass door to prevent in entrance by an intruder through the glass doors. The security door structure includes a first rigid metal frame with top and bottom rails and opposing vertical side rails and a plurality of rigid metal bars affixed between the rails. The metal bars are mounted at a predetermined distance from each other to prevent passage of a human body therebetween. The first metal frame is affixed exteriorly of the affixed glass door, and extends the same height and width as the affixed glass door. A second metal frame is pivotally mounted about a vertical axis to the first metal frame to swing between a closed position coplanar with the first metal frame and an open position pivoted exteriorly away from the coplanar position. The second metal frame includes top and bottom rails and opposing vertical side rails, and has a plurality of rigid metal bars affixed between the rails and spaced apart a distance from each other to prevent passage of a human body therebetween. A lock bracket is affixed to the interior face of the second metal frame and cooperates with a bracket mounted in the building wall opening interiorly of the security door structure, to permit selective locking of the pivotable door in the closed position, from the interior side of the security door structure.

DESCRIPTION OF THE PREFERRED EMBODIMENT

Figure 1:
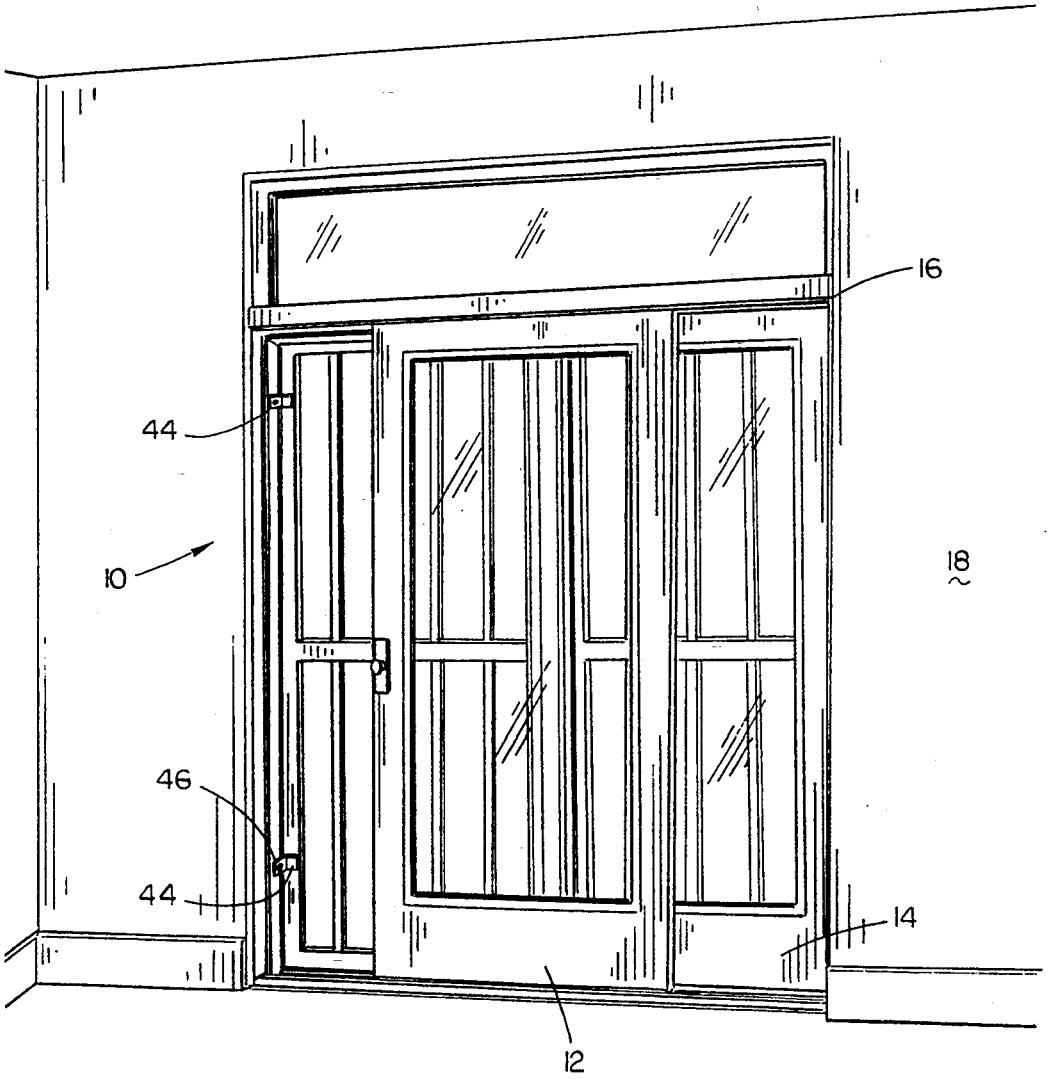
FIG. 1 is a perspective view of a sliding glass door structure with the security doors of the present invention installed on the exterior thereof.

Referring now to the drawings, in which similar or corresponding parts are identified with the same reference numeral, and more particularly to FIG. 1, the security door structure of the present invention is designated generally at 10 and is shown mounted exteriorly of a sliding glass door 12 and an associated affixed glass door 14 within a door jamb 16 mounted in a building wall 18.

Figure 2:
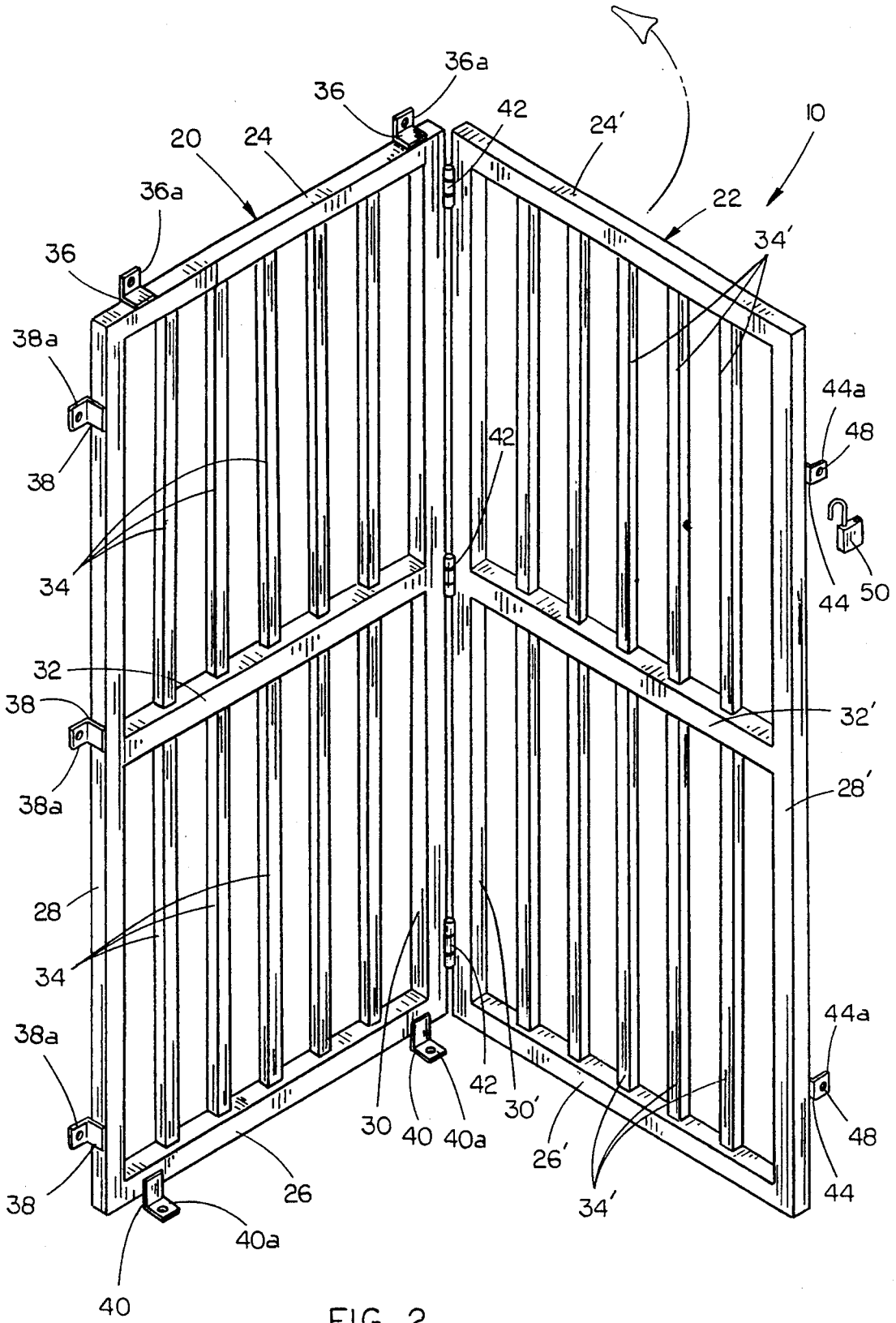
FIG. 2 is an exterior perspective view of the security door structure of the present invention.

Referring now to FIG. 2, security door structure 10 includes a fixed door 20 and an operable door 22. Fixed door 20 includes top and bottom rails 24 and 26 connected by vertical side rails 28 and 30. A horizontal center rail 32 provides extra structural support to side rails 28 and 30. A plurality of vertically oriented bars 34 are affixed between top and center rails 24 and 32 and center and bottom rails 32 and 26, respectively. A pair of generally L-shaped mounting brackets 36 are affixed to top rail 24 with a securement leg **36*a* projecting generally vertically to permit a bolt to be installed into the opening of the frame. Three generally L-shaped mounting brackets 38 are affixed along side rail 28 with a mounting leg 38*a* extending vertically and coplanar with the rearward surface of side rail 28, to permit bolts to be mounted into the opening frame of the exterior wall of a building. A pair of generally L-shaped mounting brackets are affixed to bottom rail 26 with horizontally projecting mounting legs 40*a* projecting outwardly from fixed door 20** to permit a securement bolt to be journaled therethrough downwardly into the base or floor adjacent the door.

Operable door 22 is constructed in the same fashion as fixed door 20, with a top rail 24', bottom rail 26', side rails 28' and 30', center rail 32' and vertical bars 34'. Operable door 22 is pivotally connected to side rail 30 of fixed door 20 with closed hinges 42, mounted to the corresponding side rail 30' of operable door 22. In this way, operable door 22 swings about hinges 42 from an open position, shown generally in FIG. 2, to a closed position shown in FIGS. 3 and 4, generally coplanar with fixed door 20. As shown in FIGS. 2 and 4, a pair of generally L-shaped lock brackets 44 are affixed to the rearward surface of side rail 28', with one leg **44*a* projecting perpendicularly rearwardly therefrom. Lock bracket leg 44*a* corresponds and aligns flush with a leg 46*a* of a corresponding lock bracket 46 mounted to the door jamb 16. An aperture 48 in door lock brackets legs 44*a* is dimensioned so as to receive the shackle of a padlock 50 therethrough (see FIG. 2). A similar aperture in lock brackets 46 on door jamb 16 receives padlock 50 therethrough to lock operable door 22 in the closed coplanar position shown in FIG. 4**.

Figure 3:
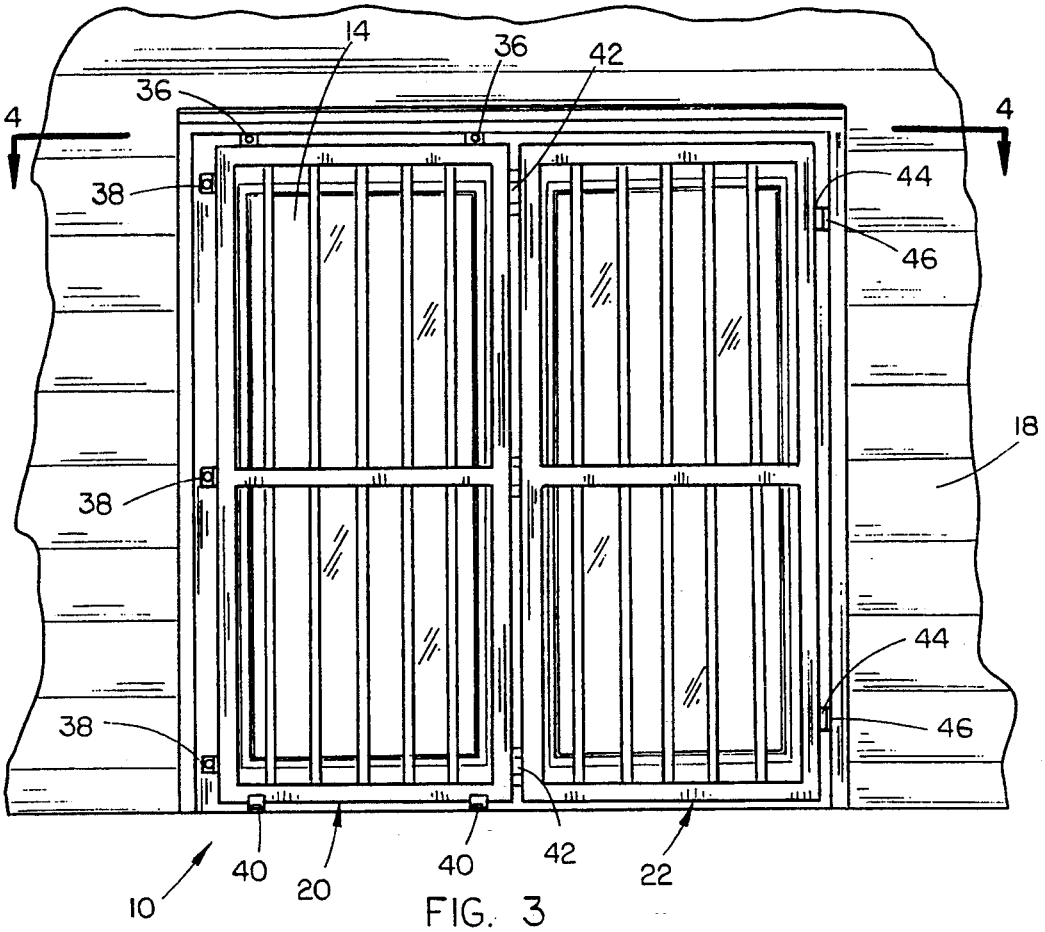
FIG. 3 is an exterior elevational view of the security door structure mounted in the sliding door opening in a building.
Figure 4:
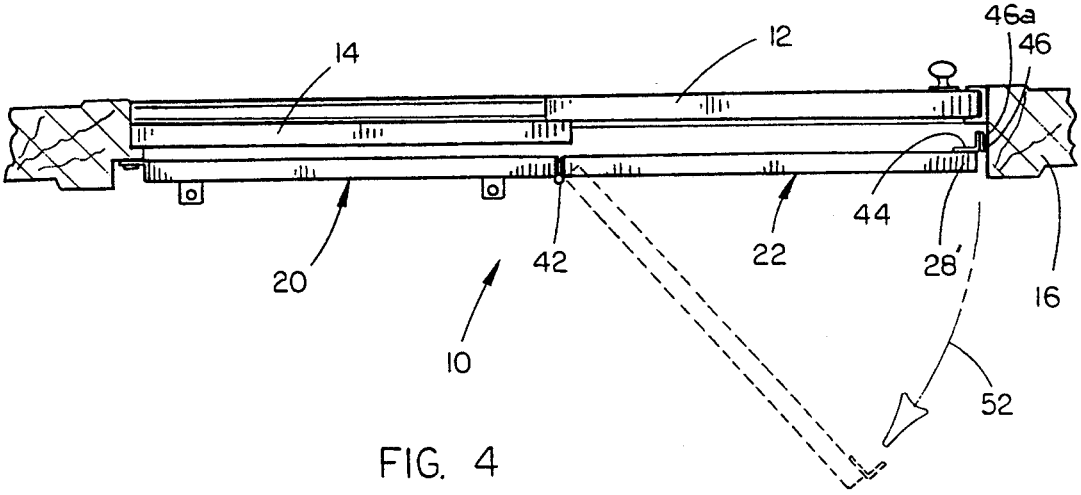
FIG. 4 is a sectional view taken at lines 4—4 in FIG. 3.

In operation, security door structure 10 is installed by first mounting a fixed door 20 in position immediately adjacent the exterior of affixed glass door 14, as shown in FIG. 3. Mounting brackets 36, 38 and 40 receive bolts therethrough to rigidly affix fixed door 20 in position. Operable door 22 is then attached to fixed door 20 with hinges 42, to permit pivotable swinging movement outwardly away from building wall 18, as shown by arrow 52 in FIG. 4. Because security door structure 10 is mounted exteriorly of sliding glass door 12 and affixed glass door 14, the swing of operable door 22 will not interfere with the operation of sliding door 12. In addition, operable door 22 may be secured on the interior side thereof from inside the house, thereby restricting access to the lock from the exterior.

Whereas the invention has been shown and described in connection with the preferred embodiment thereof, it should be understood that many modifications, substitutions and additions may be made which are within the intended broad scope of the appended claims.

I claim:

1. In a building having a wall with an opening therethrough, said wall having interior and exterior surfaces, and the opening having a fixed glass door and a slidable glass door therein selectively closing the opening, a security door structure, comprising:

a first metal frame affixed immediately adjacent said fixed glass door on the exterior of the wall within said opening and extending the same width and height as said fixed glass door, said first frame including horizontal top and bottom rails affixed to vertical spaced apart first and second side rails, the first side rail mounted adjacent one vertical side of the opening and the second side rail mounted generally centrally in said opening;

a plurality of rigid metal bars affixed between the rails of said first frame, and spaced apart a predetermined distance from each other to prevent passage of a human body therebetween;

a second metal frame operably mounted to said first frame second side rail for pivotal movement about a vertical axis;

said second metal frame including top and bottom rails affixed to vertical spaced apart first and second side rails, said second metal frame having an exterior face and an interior face;

a plurality of rigid metal bars affixed between the rails of said second frame, and spaced apart a predetermined distance from each other to prevent passage of a human body therebetween;

means on said second frame for selectively locking the second frame in a closed position generally coplanar with the first metal frame;

said second metal frame pivotable between a closed position and an open position pivoted exteriorly out of the coplanar position.

2. A method for securing an opening in a building wall, the opening having a fixed glass door in one portion thereof and a slidable glass door selectively closing the remaining portion of the opening, comprising the steps of:

affixing a first metal frame immediately adjacent and on the exterior of the fixed glass door to the building wall, the first frame extending the same width and height as the fixed glass door, and having a plurality of rigid metal bars affixed therein and spaced apart a distance to prevent passage of a human body between the bars;

pivotally connecting a second metal frame to the first metal frame to pivot about a vertical axis from a closed position generally coplanar with the first frame to an open position pivoted exteriorly of the coplanar position, the second metal frame having a plurality of rigid metal bars affixed therein and spaced apart a distance to prevent passage of a human body between the bars;

mounting a first half of a locking apparatus onto an interior face of the second metal frame for pivotal movement therewith;

mounting a second half of a locking apparatus to the building wall in said opening, adjacent the slidable glass door; and selectively securing the first and second halves of the locking apparatus when the second frame is pivoted to the closed position.

* * * * *